US006927785B2

(12) United States Patent
Kobayashi

(10) Patent No.: US 6,927,785 B2
(45) Date of Patent: Aug. 9, 2005

(54) PULSE WIDTH MODULATION SIGNAL GENERATION CIRCUIT, DATA LINE DRIVE CIRCUIT, ELECTRO-OPTICAL DEVICE, AND ELECTRONIC INSTRUMENT

(75) Inventor: Kazuo Kobayashi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 449 days.

(21) Appl. No.: 10/283,031

(22) Filed: Oct. 29, 2002

(65) Prior Publication Data

US 2003/0090499 A1 May 15, 2003

(30) Foreign Application Priority Data

Nov. 8, 2001 (JP) ..... 2001-343211

(51) Int. Cl.[7] ..... G09G 3/36

(52) U.S. Cl. ..... 345/691; 345/89; 345/98; 345/100; 345/211

(58) Field of Search ..... 345/87–89, 94–100, 345/690–693, 211

(56) References Cited

U.S. PATENT DOCUMENTS 4,775,891 A * 10/1988 Aoki et al. ..... 348/572
5,196,738 A * 3/1993 Takahara et al. ..... 327/530
5,337,070 A * 8/1994 Kitajima et al. ..... 345/211
5,583,530 A * 12/1996 Mano et al. ..... 345/89
5,764,212 A * 6/1998 Nishitani et al. ..... 345/98
6,043,801 A * 3/2000 Bassetti ..... 345/89
6,094,243 A * 7/2000 Yasunishi ..... 349/33
6,353,435 B2 * 3/2002 Kudo et al. ..... 345/204
6,377,234 B1 * 4/2002 Nogawa ..... 345/89
6,597,371 B2 * 7/2003 Mandl ..... 345/691
2002/0012008 A1 * 1/2002 Takagi ..... 345/691

FOREIGN PATENT DOCUMENTS

JP 08-008727 1/1996
JP 11-231835 8/1999

* cited by examiner

*Primary Examiner*—Xiao Wu
(74) *Attorney, Agent, or Firm*—Hogan & Hartson, LLP

(57) ABSTRACT

The present invention provides a pulse width modulation signal generation circuit that generates pulse width modulation signals that can suppress the increase in power consumption caused by the increase in grayscale, together with a data line drive circuit, electro-optical device, and electronic instrument that use the same. The pulse width modulation signal generation circuit generates a pulse width modulation signal based on (a+b) bits of grayscale data that have been read from RAM. During that time, the circuit detects a match between a first count value and the high-order the a-bit grayscale data and a match between a second count value, which is one less than that first count value, and the high-order the a-bit grayscale data. In a decoder circuit, one of the match detection results is used to output a pulse width modulation signal, in correspondence with a result of decoding a frame number and the low-order b-bit the grayscale data.

20 Claims, 13 Drawing Sheets

FIG. 9

| frame1 | frame2 | frame3 | frame4 | PD1 | PD0 | COUNT VALUE |
|---|---|---|---|---|---|---|
| H | L | L | L | H | H | CA |
| L | H | L | L | | | CA |
| L | L | H | L | | | CA |
| L | L | L | H | | | CA |
| H | L | L | L | H | L | CB |
| L | H | L | L | | | CA |
| L | L | H | L | | | CA |
| L | L | L | H | | | CA |
| H | L | L | L | L | H | CB |
| L | H | L | L | | | CB |
| L | L | H | L | | | CA |
| L | L | L | H | | | CA |
| H | L | L | L | L | L | CB |
| L | H | L | L | | | CB |
| L | L | H | L | | | CB |
| L | L | L | H | | | CA |

PULSE WIDTH MODULATION SIGNAL GENERATION CIRCUIT, DATA LINE DRIVE CIRCUIT, ELECTRO-OPTICAL DEVICE, AND ELECTRONIC INSTRUMENT

Japanese Patent Application No. 2001-343211, filed on Nov. 8, 2001, is hereby incorporated by reference in its entirety.

BACKGROUND

The present invention relates to a pulse width modulation signal generation circuit together with a data line drive circuit, an electro-optical device, and an electronic instrument using the same.

An electro-optical device makes it possible to provide an image display with a wider range of colors, by increasing grayscale. Known grayscale display methods that enable such an image display include a frame modulation method (frame rate modulation, abbreviated to FRM herein) and a pulse-width modulation method (abbreviated to PWM herein).

FRM enables the effective display of two or more grayscales by variations in time-averaged effective voltages obtained by switching two grayscales on or off appropriately in frame units over a plurality of frames.

With PWM, grayscale display can be done by a voltage drive with pulse widths corresponding to the desired grayscale value, for each frame.

SUMMARY

One aspect of the present invention relates to a pulse width modulation signal generation circuit which generates a pulse width modulation signal for performing grayscale display based on (a+b) bits of grayscale data (where "a" and "b" are natural numbers). The pulse width modulation signal generation circuit includes a first match detection circuit which detects a match between a-bit grayscale data and a first count value counted within a given scan period; a second match detection circuit which detects a match between the a-bit grayscale data and a second count value counted by subtracting or adding one with respect to the first count value; and a selection signal generation circuit which generates a selection signal based on a frame number for identifying a frame and b-bit grayscale data.

A transition point in the pulse width modulation signal is defined by one of the match detection results of the first and second match detection circuits, selected based on the selection signal.

Another aspect of the present invention relates to an electro-optical device including a panel having a pixel defined by one of a plurality of scan lines and one of a plurality of data lines crossing each other; the data line drive circuit as described above, which drives the plurality of data lines; and a scan line drive circuit which drives the plurality of scan lines.

A further aspect of the present invention relates to a pulse width modulation signal generation method for generating a pulse width modulation signal for performing grayscale display, based on (a+b) bits of grayscale data (where "a" and "b" are natural numbers). The method includes performing match detection between a-bit grayscale data and a first count value counted within a given scan period, and match detection between the a-bit grayscale data and a second count value counted by subtracting or adding one with respect to the first count value. The method also includes generating a pulse width modulation signal in which a transition point is defined by the match detection result of one of the first and second count values, selected by a selection signal generated based on a frame number for identifying the frame and b-bit grayscale data.

BRIEF DESCRIPTION OF THE SEVERAL VIEWS OF THE DRAWING

FIG. 9 is illustrative of a typical truth table when the decoder circuit of this embodiment is implemented by ROM;

DETAILED DESCRIPTION OF THE EMBODIMENT

Figure 1:
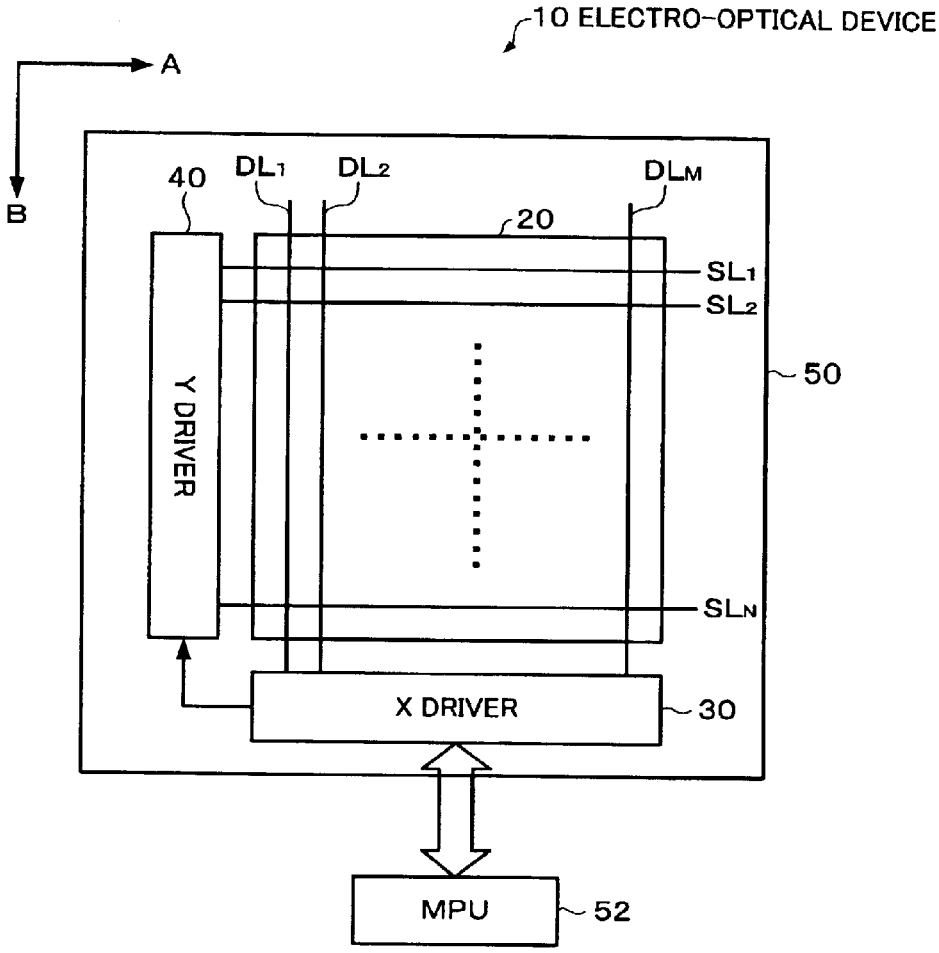
FIG. 1 is a block diagram of an example of the configuration of an electro-optical device in accordance with this embodiment.

Embodiments of the present invention are described below. Note that the embodiments described below do not in any way limit the scope of the present invention as laid out in the claims herein. In addition, the entirety of the configuration described with reference to these embodiments is not limited to being essential structural components of the present invention.

If FRM is applied to larger numbers of grayscales under conditions in which the responsiveness of a liquid-crystal material has been speeded up with the objective of improving the display of moving images and the contrast ratio, a problem arises in that flickering can easily occur instead.

In contrast thereto, PWM can be applied to grayscale display without the necessity of switching at each frame. However, when PWM is applied to larger numbers of grayscales, it is necessary to move the clock pulse signal (GCP signal), which acts as a reference, to a higher frequency during a fixed scan period when it comes to determining the pulse width of the pulse width modulation signal, raising a problem in that it leads to an increase in the power consumption.

This embodiment makes it possible to supply a pulse width modulation signal generation circuit for generating a pulse width modulation signal that can suppress any increase in power consumption due to an increase in grayscale, together with a data line drive circuit, electro-optical device, and electronic instrument using the same.

An embodiment of the present invention provides a pulse width modulation signal generation circuit which generates a pulse width modulation signal for performing grayscale display based on (a+b) bits of grayscale data (where "a" and "b" are natural numbers), the pulse width modulation signal generation circuit comprising:

a first match detection circuit which detects a match between a-bit grayscale data and a first count value counted within a given scan period;

a second match detection circuit which detects a match between the a-bit grayscale data and a second count value counted by subtracting or adding one with respect to the first count value; and a selection signal generation circuit which generates a selection signal based on a frame number for identifying the frame and b-bit grayscale data, wherein a transition point in the pulse width modulation signal is defined by one of the match detection results of the first and second match detection circuits, selected based on the selection signal.

In this case, match detection not only involves the detection of whether or not two values that are comparison targets are equal in bit units; it also comprises the detection of a substantially equivalent state, such as whether or not the two values that are comparison targets are mutually complementary in bit units.

Since this embodiment makes it possible to generate a pulse width modulation signal defined by a match detection by one of a first count and a second count obtained by subtracting or adding one with respect to that first count, it enables the implementation of a grayscale display having substantially the same display quality as (a+b)-bit grayscale display, with a simple configuration and without increasing the frequency, by a combination of a-bit PWM and b-bit FRM with substantially the same power consumption as a-bit PWM. It is therefore possible to apply this embodiment to a grayscale display of greater depth without increasing the power consumption, even when the grayscale increases further.

A pulse width modulation signal generation circuit in accordance with this embodiment may further comprise:

a pre-charge circuit including a p-type transistor having a source terminal connected to a power source on a high-potential side and a gate electrode to which is applied a given pre-charge signal; and a latch circuit connected to a drain terminal of the p-type transistor, for outputting the pulse width modulation signal, the first match detection circuit may include:

first to a-th n-type transistors connected in series, a signal for each bit of the first count value being applied to a gate electrode of each of the first to a-th n-type transistors;

(a+1)th to 2a-th n-type transistors which are connected to source terminals and drain terminals of the first to a-th n-type transistors respectively, a signal for each bit of the a-bit grayscale data corresponding to each bit of the first count value being applied to a gate electrode of each of the (a+1)th to 2a-th n-type transistors;

a (2a+1)th n-type transistor having a drain terminal connected to source terminals of the a-th and 2a-th n-type transistors and a gate electrode to which an inversion signal of the selection signal is applied; and a (2a+2)th n-type transistor having a drain terminal connected to a source terminal of the (2a+1)th n-type transistor, a gate electrode to which the given pre-charge signal is applied, and a source terminal to which a power source on a low-potential side is connected, the drain terminal of the p-type transistor may be connected to the drain terminal of the first n-type transistor, the second match detection circuit may include:

(2a+3)th to (3a+2)th n-type transistors connected in series, a signal for each bit of the second count value being applied to a gate electrode of each of the (2a+3)th to (3a+2)th n-type transistors;

(3a+3)th to (4a+2)th n-type transistors, which are connected to source terminals and drain terminals of the (2a+3)th to (3a+2)th n-type transistors respectively, the signal for each bit of the a-bit grayscale data corresponding to each bit of the second count value being applied to a gate electrode of each of the (3a+3)th to (4a+2)th n-type transistors;

a (4a+3)th n-type transistor having a drain terminal connected to the source terminals of the (3a+2)th and (4a+2)th n-type transistors and a gate electrode to which the selection signal is applied; and a (4a+4)th n-type transistor having a drain terminal connected to a source terminal of the (4a+3)th n-type transistor, a gate electrode to which the given pre-charge signal is applied, and a source terminal to which a power source on the low-potential side is connected, and the drain terminal of the p-type transistor may be connected to the drain terminal of the (2a+3)th n-type transistor.

Since this feature makes it possible to configure substantially all of the components of the first and second match detection circuits of series-connected n-type transistors, it enables the provision of a pulse width modulation signal generation circuit that can provide the above described low power consumption without any wastage of layout area, and which can also cope with greater grayscale.

Another embodiment of the present invention provides a data line drive circuit which drives data lines of an electro-optical device including scan lines and the data lines in which a pixel is defined by one of the scan lines and one of the data lines crossing each other, the data line drive circuit comprising an output cell for each of the data lines, wherein the output cell includes:

a RAM which stores (a+b) bits of grayscale data;

the pulse width modulation signal generation circuit described above, which generates a pulse width modulation signal based on the grayscale data; and a level conversion circuit which converts the pulse width modulation signal to a given potential level to output to the corresponding data line.

This embodiment make it possible to implement a grayscale display having substantially the same display quality as (a+b)-bit grayscale display, without increasing the mounting area, by a combination of a-bit PWM and b-bit FRM with substantially the same power consumption as a-bit PWM.

An electro-optical device in accordance with a further embodiment of the present invention comprises:

a pixel defined by one of a plurality of scan lines and one of a plurality of data lines crossing each other;

the data line drive circuit described above, which drives the plurality of data lines; and a scan line drive circuit which drives the plurality of scan lines.

This embodiment make it possible to implement a grayscale display having substantially the same display quality as (a+b)-bit grayscale display, without increasing size of the device, by a combination of a-bit PWM and b-bit FRM with substantially, the same power consumption as a-bit PWM.

An electro-optical device in accordance with a still further embodiment of the present invention comprises:

a panel having a pixel defined by one of a plurality of scan lines and one of a plurality of data lines crossing each other;

the data line drive circuit described above, which drives the plurality of data lines; and a scan line drive circuit which drives the plurality of scan lines.

This embodiment make it possible to implement a grayscale display having substantially the same display quality as (a+b)-bit grayscale display, without increasing the device size, by a combination of a-bit PWM and b-bit FRM with substantially the same power consumption as a-bit PWM.

An electronic instrument in accordance with an even further embodiment of the present invention comprises the above-described electro-optical device.

This embodiment make it possible to provide an electronic instrument that can implement a grayscale display having substantially the same display quality as (a+b)-bit grayscale display, by a combination of a-bit PWM and b-bit FRM with substantially the same power consumption as a-bit PWM.

A yet further embodiment of the present invention provides a pulse width modulation signal generation method for generating a pulse width modulation signal for performing grayscale display, based on (a+b) bits of grayscale data (where "a" and "b" are natural numbers), the method comprising:

performing match detection between a-bit grayscale data and a first count value counted within a given scan period, and match detection between the a-bit grayscale data and a second count value counted by subtracting or adding one with respect to the first count value; and generating a pulse width modulation signal in which a transition point is defined by the match detection result of one of the first and second count values, selected by a selection signal generated based on a frame number for identifying the frame and b-bit grayscale data.

Since this embodiment make it possible to generate a pulse width modulation signal defined by a match detection by one of a first count and a second count obtained by subtracting or adding one with respect to that first count, it enables the implementation of a grayscale display having substantially the same display quality as (a+b)-bit grayscale display, with a simple configuration and without increasing the frequency, by a combination of a-bit PWM and b-bit FRM with substantially the same power consumption as a-bit PWM. It is therefore possible to apply the present invention to a grayscale display of greater depth without increasing the power consumption, even when the grayscale increases further.

Embodiments of the present invention are described below with reference to the accompanying figures.

1. Electro-Optical Device

The configuration of an electro-optical device in accordance with this embodiment is shown in FIG. 1.

An electro-optical device 10 comprises a liquid-crystal panel (generally speaking: a panel) 20, an X driver (SEG driver) (generally speaking: a data line drive circuit) 30, and a Y driver (COM driver) (generally speaking: a scan line drive circuit) 40. The liquid-crystal panel 20, the X driver 30, and the Y driver 40 are mounted on a substrate 50. The substrate 50 could be a liquid-crystal panel such as a transparent insulating substrate, a printed circuit board, or a flexible circuit board, which is connected electrically by wiring or the like to drivers, although a glass substrate is used in this embodiment.

The liquid-crystal panel 20 is divided into a plurality of regions in a direction A and into another plurality of regions in a direction B. One pixel (dot) is defined by one region among the plurality of regions provided in direction A and one region among the plurality of regions provided in direction B. Assume that there are 160 regions in direction A and 120 regions in direction B, by way of example, so that the liquid-crystal panel 20 has 160×120 pixels. In this embodiment of the invention, each pixel region comprises an active element (switching element).

In order to define the regions corresponding to the pixels in this manner, a plurality of data lines $DL_1$ to $DL_M$(where M is a natural number greater than 1) is provided in the direction A and a plurality of scan lines $SL_1$ to $SL_N$(where N is a natural number greater than 1) is provided in the direction B.

Figure 2:
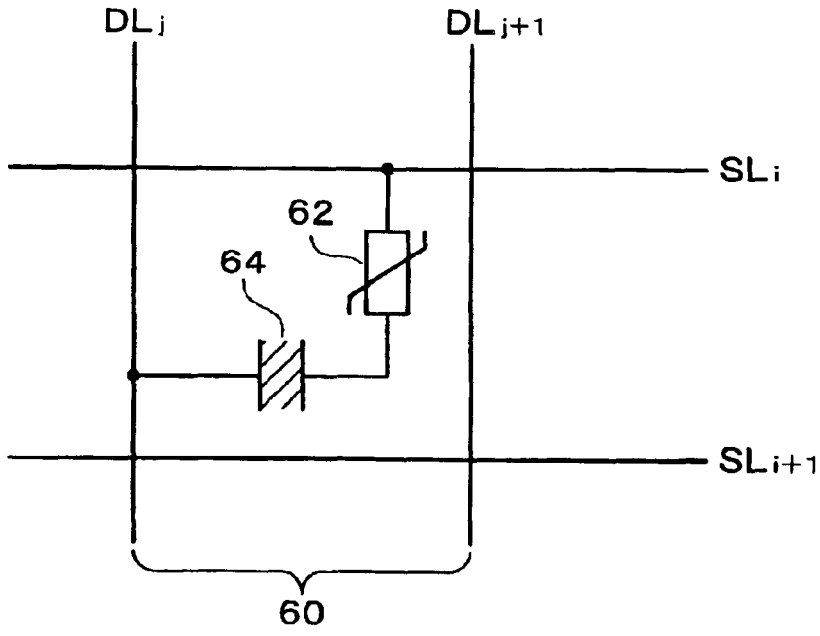
FIG. 2 shows an example of the structure of a pixel of the liquid-crystal panel in accordance with this embodiment.

An example of the structure of a pixel of the liquid-crystal panel 20 is shown in FIG. 2.

In this case, a pixel region 60 defined by a data line and a scan line shows a structural example of a pixel having a thin-film diode (TFD) as a two-terminal nonlinear element (two-terminal switching element).

In this configuration, a TFD 62 and an electro-optical material (liquid-crystal material) 64 are connected electrically in series between a scan line $SL_i$ (where $1 \leqq i \leqq N$ and i is a natural number) and a data line $DL_j$ (where $1 \leqq j \leqq M$ and j is a natural number) in the pixel region 60. Note that the TFD 62 is shown connected to the scan line $SL_i$ side and the electro-optical material 64 is connected to the data line $DL_j$ side, but the configuration could equally well be such that the TFD 62 is connected to the data line $DL_j$ side and the electro-optical material 64 is connected to the scan line $SL_i$ side.

The thus-configured TFD 62 is controlled to turn on and off by the potential difference between the scan line $SL_i$ and the data line $DL_j$. If a voltage larger than the threshold voltage of the TFD 62 is applied during the pixel selection period, therefore, the TFD 62 is turned on and a data signal supplied by the data line $DL_j$ is written to the electro-optical material 64. The potential of the scan line $SL_i$, on the other hand, is set in such a manner that the potential difference between the scan line $SL_i$ and the data line $DL_j$ during the period in which the pixel is not selected is less than the threshold voltage of the TFD 62.

By controlling the potential to which the scan line $SL_i$ is set in this manner, it is possible to store a charge corresponding to the data signal supplied by the data line $DL_j$. This makes it possible to make use of the static characteristics of the electro-optical material 64 and thus enable an increase in pixel image quality.

The plurality of data lines used to define the above-described pixels is connected to a plurality of output terminals (SEG output electrodes) of the X driver 30. The plurality of scan lines is connected to a plurality of output terminals (COM output electrodes) of the Y driver 40.

The liquid-crystal panel 20 is driven by the cooperative efforts of the X driver 30 and the Y driver 40, based on image data supplied from an external MPU (a host such as a CPU).

Note that the MPU 52 can control the display timing by supplying display control signals to the X driver 30. The X driver 30 is configured in such a manner that it can control the scan timing of the Y driver 40 in accordance with the instructions from the MPU 52.

The X driver 30 of this embodiment performs grayscale display by PWM and FRM.

Figure 3:
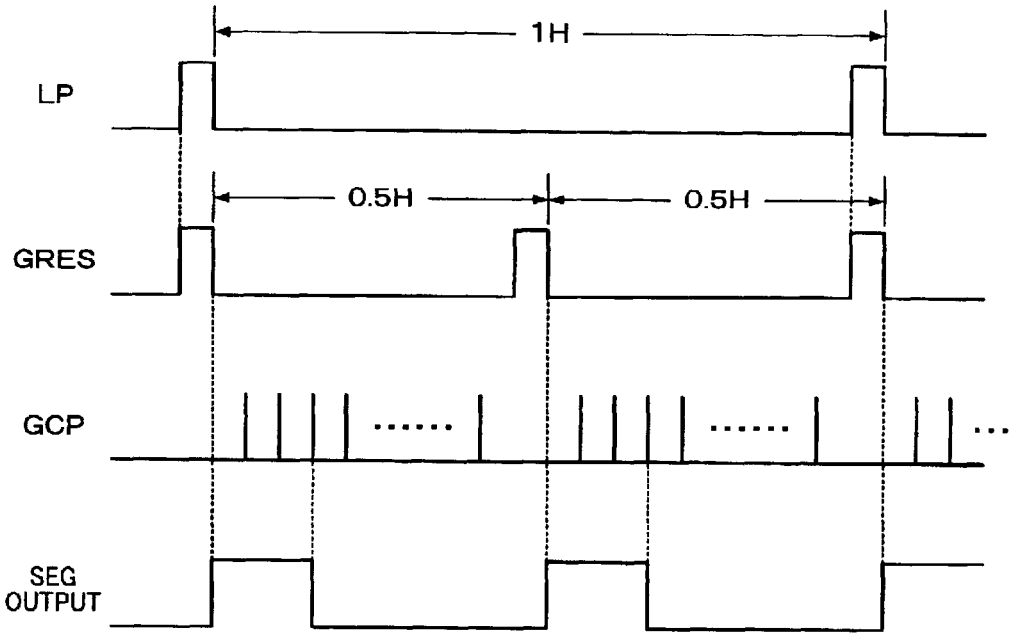
FIG. 3 is a timing chart illustrating grayscale display by PWM.

A timing chart illustrating grayscale display by PWM is shown in FIG. 3.

This timing chart shows the various signals of the X driver 30 during one horizontal scan period (1 H).

The 1 H period is defined by the X driver 30 between falling edges of a latch pulse signal LP. Two reset signals GRES are generated within 1 H by the X driver 30 with reference to rising edges of the latch pulse signal LP, thus dividing the 1 H period into two 0.5 H periods. Clock pulse signals GCP of a number (frequency) corresponding to the grayscale depth supported by the X driver 30 are generated within each 0.5 H period. If the rising of the pulse width modulation signals is regulated with reference to the falling edge of the reset signal GRES, therefore, it is possible to generate a pulse width modulation signal in which a transition point is defined by the position at which a number of pulses corresponding to the grayscale data appears, of the pulses of the clock pulse signal GCP that are output. The X driver 30 drives the corresponding data line as a SEG output, based on this pulse width modulation signal.

Since data drive in this embodiment is performed based on pulse width modulation signal every 0.5 H, it is possible to reduce cross-talk and prevent any deterioration of the display quality, in comparison with methods by which it is done every 1 H.

With PWM, however, an increase in grayscale makes it necessary to have a larger number of clock pulse signals GCP in the period regulated by the reset signal GRES within 1 H or 0.5 H, so that the frequency of the clock pulse signal GCP is increased, leading to an increase in the power consumption. This means that it is inconvenience for incorporation in a portable electronic instrument.

The X driver 30 of this embodiment therefore avoids this inconvenience by performing grayscale display by a combination of PWM and FRM. To implement a display with 64 ($=2^6$) grayscale levels, for example, 16 ($=2^4$) levels of grayscale are implemented by PWM and 4 ($=2^2$) levels are implemented by FRM. In other words, 6 (=a+b) bits of grayscale data are used to give a high-order 4 (=a) bits of grayscale display by PWM and a low-order 2 (=b) bits of grayscale display by FRM. This makes it possible to achieve substantially the same display quality as 64-grayscale display by PWM, but with substantially the same power consumption as 16-grayscale display by PWM.

Figure 4:
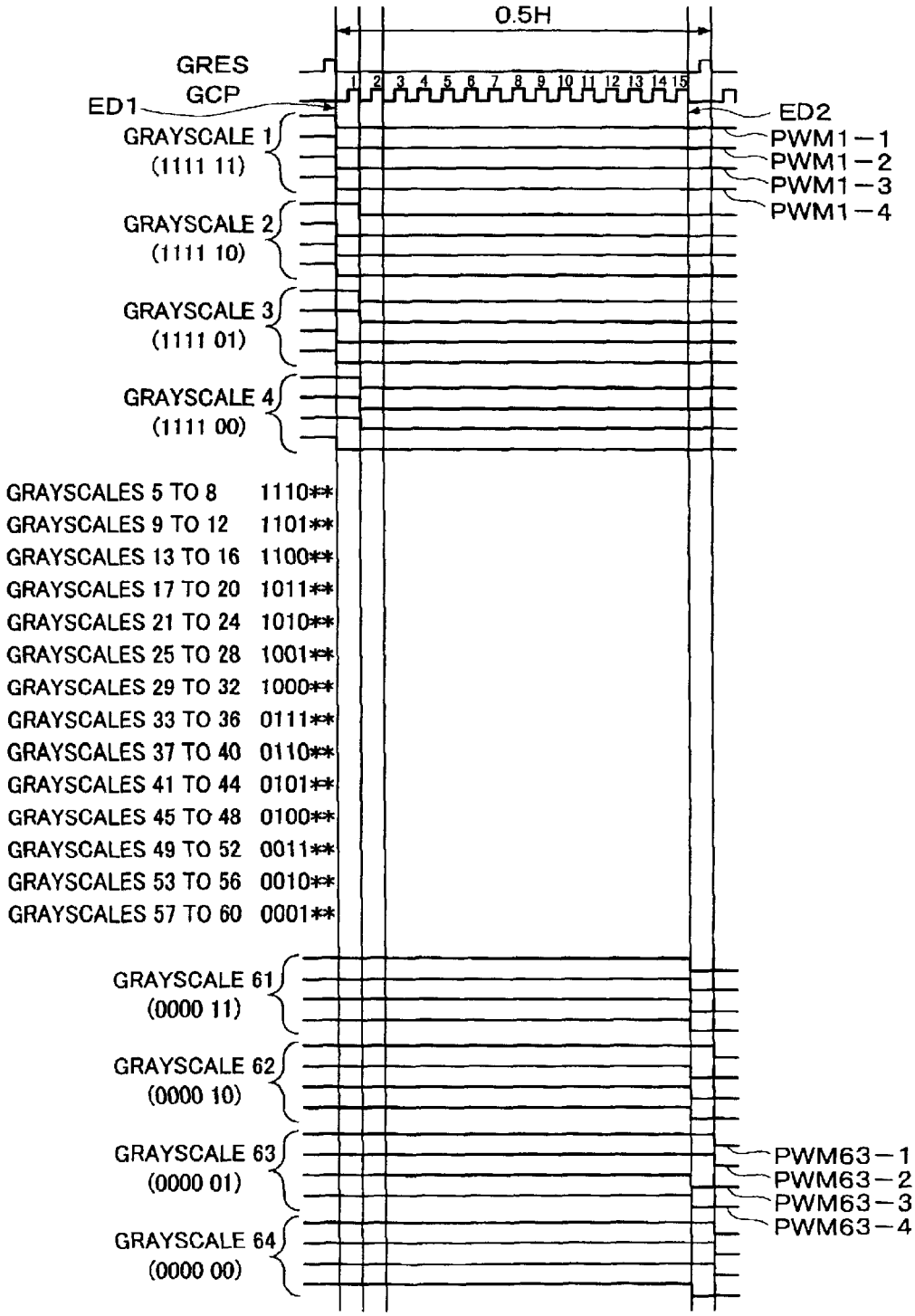
FIG. 4 is an example of a timing chart illustrating grayscale data by a combination of 4-bit PWM and 2-bit FRM.

A timing chart illustrating grayscale display by a combination of 4-bit PWM and 2-bit FRM is shown in FIG. 4.

If 15 clock pulse signals GCP appear within 0.5 H, by way of example, a transition point of the pulse width modulation signal (a transition point from a first level to a second level) is defined at an edge of the clock pulse signal GCP corresponding to that 4-bit grayscale data, by PWM based on the high-order 4 bits of the grayscale data. Note that the pulse width modulation signal has another transition point (a transition point from the second level to the first level) at the falling edge of the reset signal GRES.

The pulse width modulation signal for that grayscale data has four patterns corresponding to the low-order two bits of the grayscale data, which are switched and output for each frame by FRM.

If the 6-bit grayscale data is "111111" (grayscale 1), by way of example, the pulse width modulation signal has a transition point within each frame defined by the edge (ED1) of the clock pulse signal GCP determined by the high-order four bits "1111" and the falling edge of the reset signal GRES, and the output is sequentially switched in each frame through the patterns PWM 1-1, PWM 1-2, PWM 1-3, and PWM 1-4 determined by the low-order two bits "11".

Similarly if the 6-bit grayscale data is "000001" (grayscale 63), by way of example, the pulse width modulation signal has a transition point within each frame defined by the edge (ED2) of the clock pulse signal GCP determined by the high-order four bits "0000" and the and the output is sequentially switched in each frame through the patterns PWM63-1, PWM63-2, PWM63-3, and PWM63-4 determined by the low-order two bits "01".

In this case, the patterns determined by the low-order two bits are configured by a combination of the pulse width modulation signal determined by the high-order four bits and a pulse width modulation signal in which the transition point of that pulse width modulation signal is displaced by one cycle of the clock pulse signal.

2. X Driver (Data Line Drive Circuit)

It is preferable that the X driver 30 that provides the above described grayscale display does not increase in size, as far as possible, to enable the SEG output by the combination of 4-bit PWM and 2-bit FRM.

The description below concerns a pulse width modulation signal generation circuit that implements grayscale display by a combination of PWM and FRM and an X driver in accordance with this embodiment incorporating that circuit, without causing any dramatic increase in additional circuit area.

Figure 5:
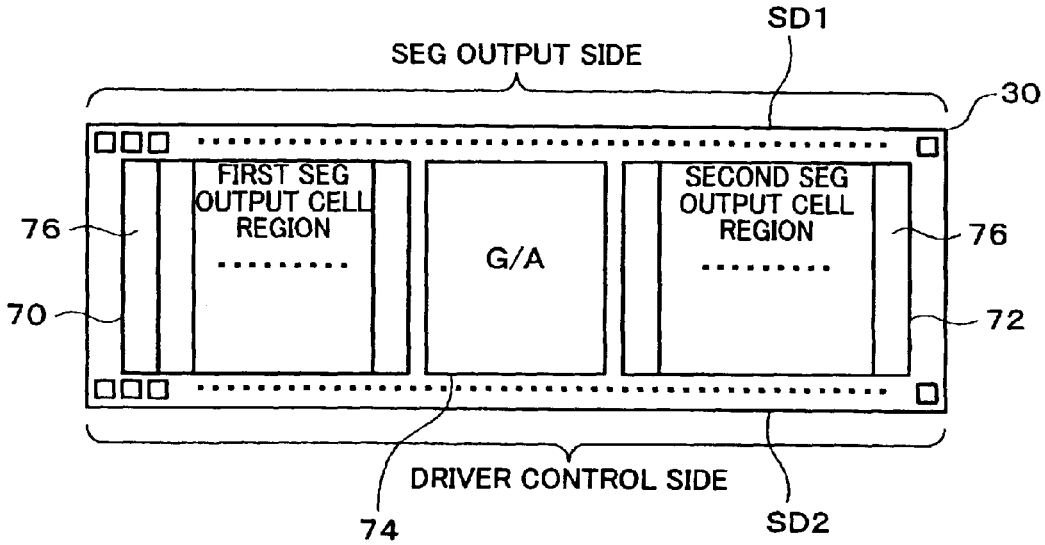
FIG. 5 shows an example of the layout of the X driver in accordance with this embodiment.

Within the X driver 30, SEG output electrodes for applying drive voltages to the data line $DL_1$ to $DL_M$ are arrayed along an edge portion of a long side SD1 of a rectangular chip, as shown in FIG. 5. Electrodes for transferring the various signals that control the X driver 30 are arrayed along an edge portion of another long side SD2 that is opposite to the first long side SD1.

The X driver 30 comprises first and second SEG output cell regions 70 and 72 and a gate array (G/A) region 74. Each of the first and second SEG output cell regions 70 and 72 has the same number of SEG output cells 76 as the SEG output electrodes for this SEG output, corresponding to the SEG output electrodes arrayed along the edge portion of the long side SD1 of the chip. The SEG output cells 76 arrayed in the first and second SEG output cell regions 70 and 72 have the same configuration. The G/A region 74 is a region in which basic cells are arrayed to configure circuitry for controlling the SEG output cells, based on various signals input through electrodes along the edge portion of the long side SD2.

The first and second SEG output cell regions 70 and 72 each have an integer number of SEG output cells equal to at least M/2. In this case, M is the number of data lines shown in FIG. 1.

Each SEG output cell 76 comprises the RAM area 80 containing grayscale data corresponding to that SEG output, a RAM control circuit 82 for writing grayscale data to that RAM 80 and reading grayscale data therefrom, and a SEG output circuit 84 for generating the pulse width modulation signal based on the grayscale data read from the RAM 80, to drive the corresponding data line.

The RAM 80 is accessed via a plurality of address lines in the direction in which the SEG output cells are arrayed. In this embodiment, the RAM 80 stores 6-bit grayscale data.

Signals for controlling the RAM 80, which are generated in the G/A region 74 of FIG. 4, are supplied to the RAM control circuit 82.

The SEG output circuit 84 generates a pulse width modulation signal based on the high-order four bits of the 6-bit grayscale data, and performs SEG output by FRM based on the low-order two bits of the 6-bit grayscale data.

It is preferable that this circuit for providing high-order 4-bit grayscale display by PWM and low-order 2-bit grayscale display by FRM is of a size such that it does not exceed the array direction C of the SEG output cell 76 or the heightwise direction D of the SEG output cell 76. In particular, the width of the SEG output cell 76 must be within the output pitch of the SEG output electrodes. If it becomes greater than the array direction C, it would become impossible to cope with any reduction in the output pitch or increase in the number of data lines, reducing the mounting efficiency. If it becomes greater in the heightwise direction, the package size would become too large.

In that case, the X driver 30 of this embodiment comprises a pulse width modulation signal generation circuit having a match detection circuit and decoder circuit of a simple configuration within the SEG output circuit 84. This makes it possible to implement an increased grayscale with a low power consumption, with substantially no increase in the circuit scale.

Figure 7:
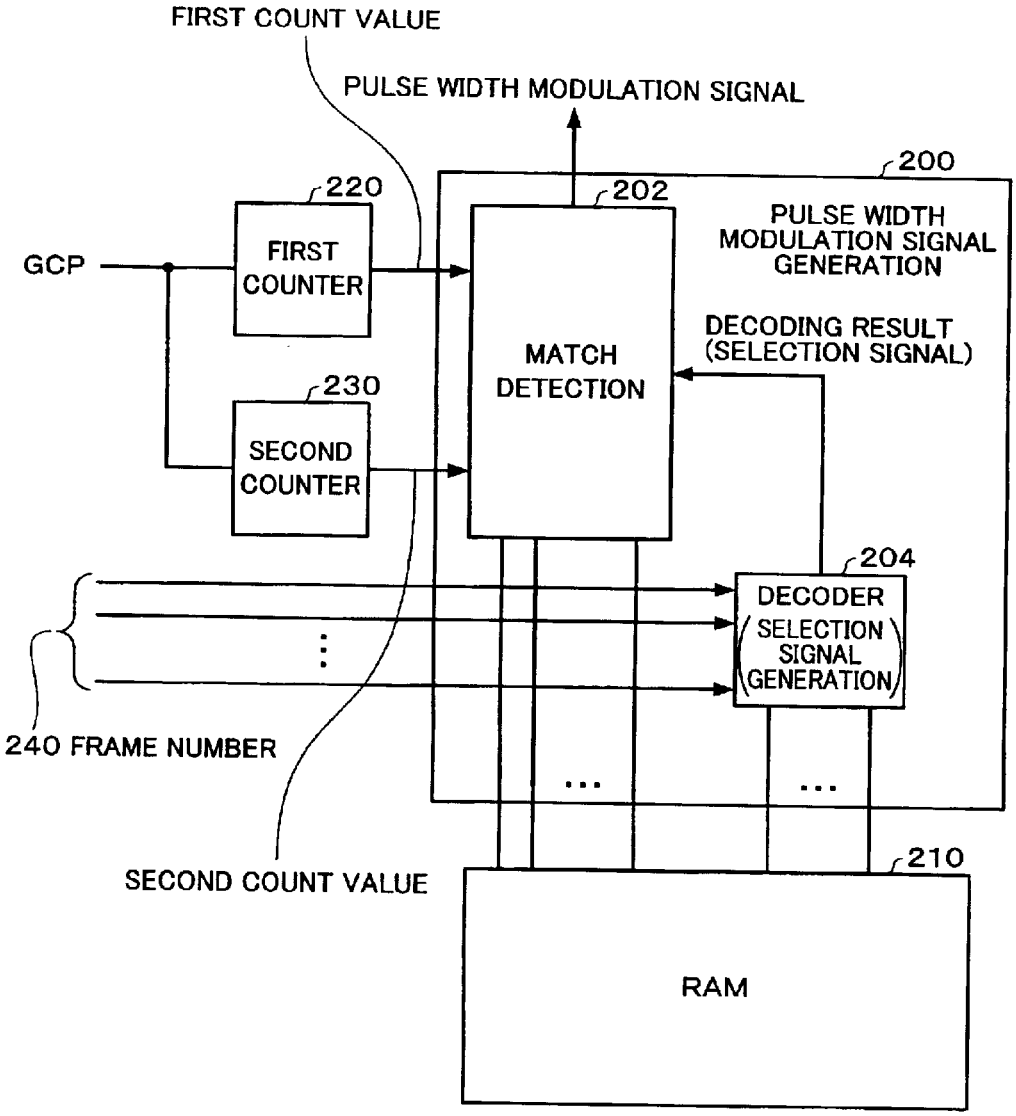
FIG. 7 shows the fundamental structure of a pulse width modulation signal generation circuit in accordance with this embodiment.

The basic configuration of this pulse width modulation signal generation circuit is shown in FIG. 7.

A pulse width modulation signal generation circuit 200 generates a pulse width modulation signal based on 6-bit (=a+b) grayscale data read from a RAM 210. During this time, match detection between a first count value and the high-order four (=a) bits of the grayscale data is performed, as well as match detection between a second count value obtained by subtracting one from the first count value and the high-order four (=a) bits of the grayscale data. One of the match detection results corresponding to a frame number 240 for identifying that frame, which is updated every frame, is used for output as the pulse width modulation signal.

Figure 6:
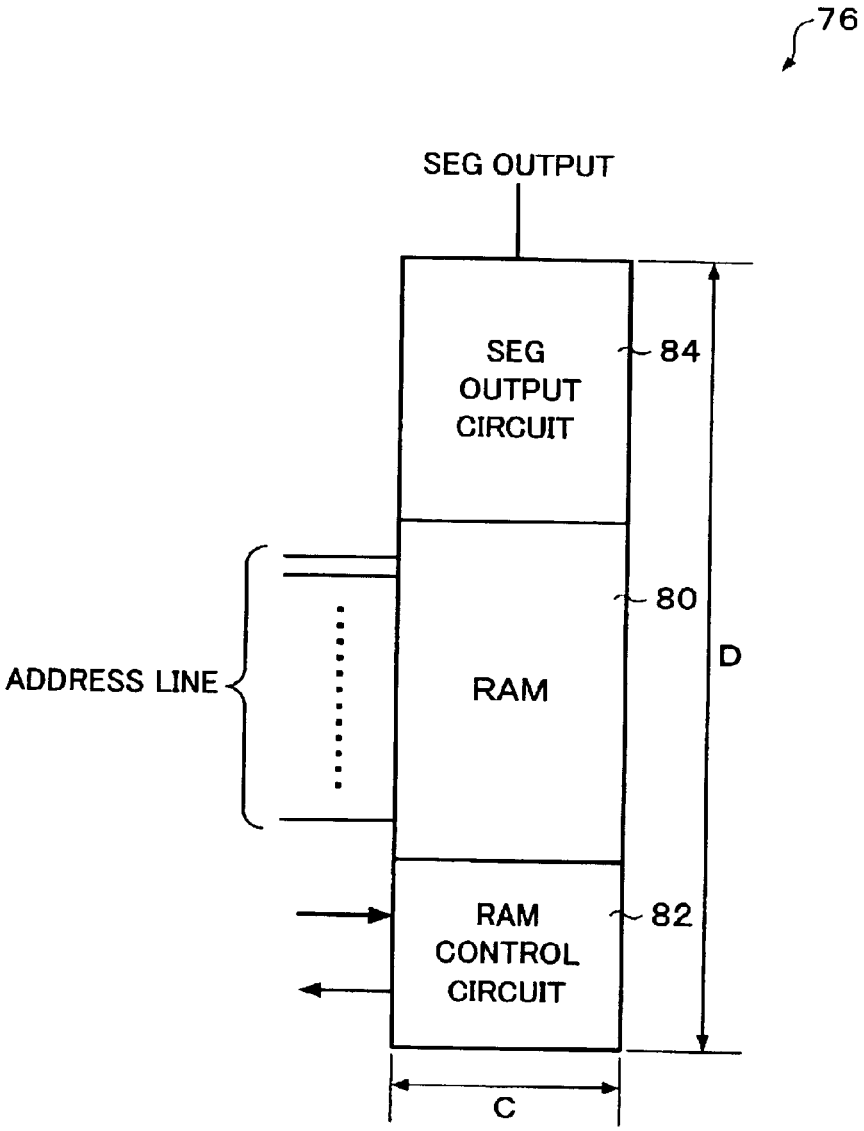
FIG. 6 is illustrative of the configuration of a SEG output cell of the X driver of this embodiment.

The RAM 210 is disposed in a RAM area 80 shown in FIG. 6. A first count value is obtained by a first counter 220 that increments the clock pulse signal GCP. The first counter 220 is disposed in the G/A region 74 shown in FIG. 5. The second count value is obtained by a second counter 230 that increments the clock pulse signal GCP, and is a value that is one less than the first count value. The second counter 230 is disposed in the G/A region 74 shown in FIG. 5. The frame number 240 is updated in frame units by the control circuit that is disposed in the G/A region 74 and controls the display timing.

The pulse width modulation signal generation circuit 200 comprises a match detection circuit 202 and a decoder circuit 204.

The match detection circuit 202 performs match detection between 4-bit grayscale data that has been read from the RAM 210 and the 4-bit first count value, and also performs match detection between that 4-bit grayscale data and the 4-bit second count value, and generates the pulse width modulation signal defining the transition point based on one of those match detection results. In this case, match detection not only involves the detection of whether or not two values that are comparison targets are equal in bit units; it also comprises the detection of states that are substantially equivalent to a match between the two, such as whether or not the two values that are comparison targets are mutually complementary in bit units.

The decoder circuit 204 supplies a selection signal for selecting one of the two match detection results obtained from the frame number and the low-order two bits of the grayscale data, as the decoding result. This decoder circuit 204 could be implemented by ROM, by way of example.

Since the first count value is obtained by incrementing the clock pulse signal GCP, it is possible to generate a pulse width modulation signal in which a transition point is defined in accordance with the grayscale data. In contrast thereto, the second count value is obtained by subtracting one from the first count value. This second count value could be obtained by incrementation of the clock pulse signal GCP after a delay of one cycle during the count, or it could be obtained by delaying the first count value by one cycle of the clock pulse signal GCP.

In this manner, a count value that is compared with the high-order four bits of the grayscale data is switched on the basis of the low-order two bits of the grayscale data and the frame number, making it possible to use FRM based on the low-order two bits of the grayscale data to modify a pulse width modulation signal in which a transition point is defined by this match detection result. It is therefore simple to implement a grayscale display from a combination of PWM based on 4-bit grayscale data and FRM based on 2-bit grayscale data.

Figure 8:
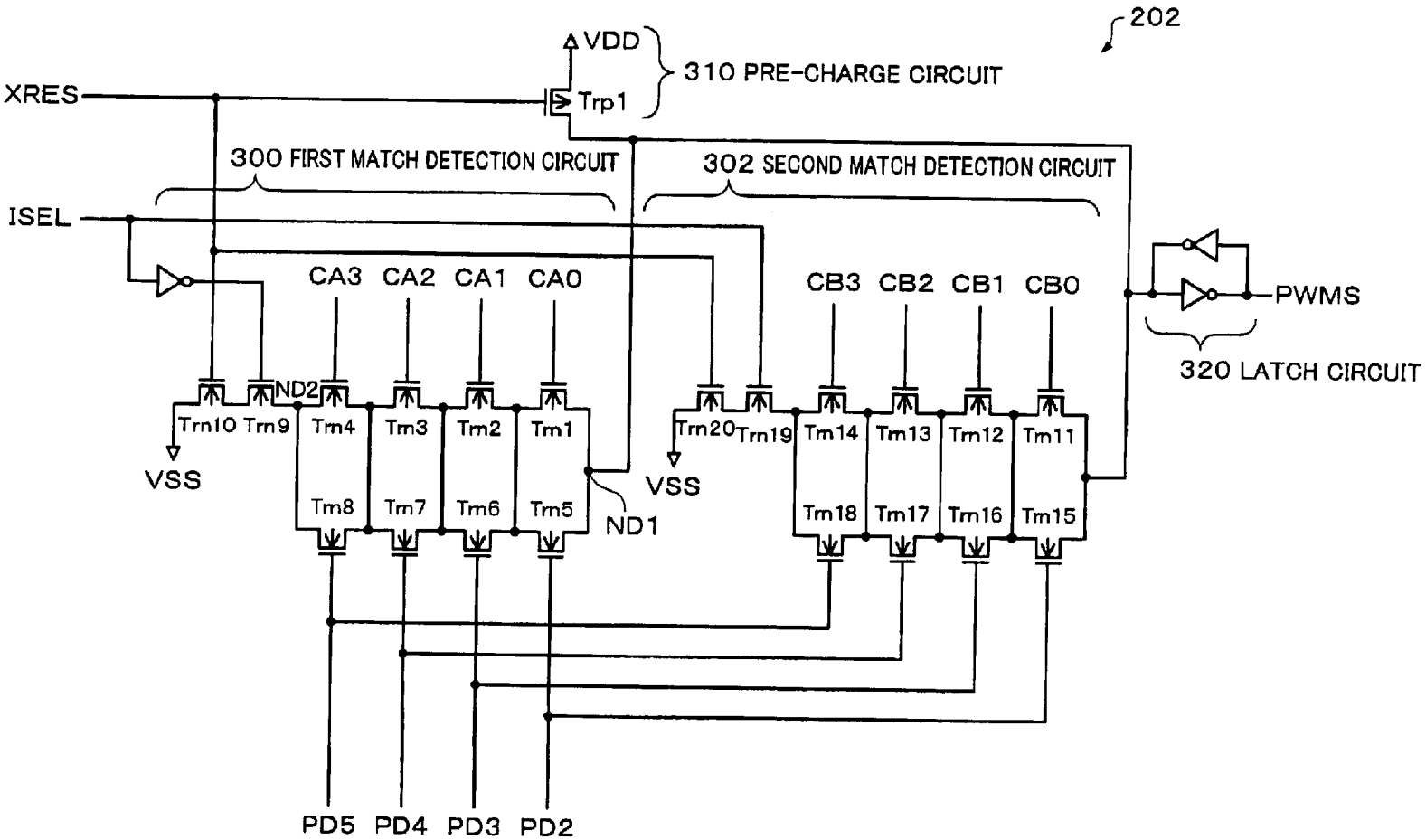
FIG. 8 is a circuit diagram of an example of the configuration of the match detection circuit of this embodiment.

An example of the configuration of the match detection circuit of this embodiment is shown in FIG. 8.

In this case, the description concerns match detection for four (=a) bits of grayscale data, but similar configurations with other numbers of bits are also possible.

The match detection circuit 202 comprises first and second match detection circuits 300 and 302, a pre-charge circuit 310, and a latch circuit 320.

A first match detection circuit 300 and a second match detection circuit 302 have similar configurations and an output node of each circuit is connected to the pre-charge circuit 310 and the latch circuit 320, respectively.

The first match detection circuit 300 comprises first to fourth n-type MOS transistors (Trn1 to Trn4), where signals CA0 to CA3 of the bits for the first count value are applied (supplied) to the gate electrodes of these series-connected transistors (with CA0 on the LSB side), and fifth to eighth n-type MOS transistors (Trn5 to Trn8), where the source and drain terminals thereof are connected to the corresponding terminals of the Trn1 to Trn4 transistors and signals PD2 to PD5 of the bits of the high-order four bits of the grayscale data are applied to the gate electrodes thereof. The signals CA0 to CA3 of the bits for the first count value thus correspond to the signals PD2 to PD5 of the high-order four bits of the grayscale data. The source terminals of Trn4 and Trn8 are connected to the drain terminal of a ninth n-type MOS transistor (Trn9). An inversion of a selection signal ISEL is applied to the gate electrode of Trn9. In addition, the drain terminal of a tenth n-type MOS transistor (Trn10) is connected to the source terminal of Trn9. An inverted reset signal XRES that is an inversion of the reset signal GRES is applied to the gate electrode of Trn10, and a power source VSS on the low-potential side is connected to the source terminal thereof.

The second match detection circuit 302 comprises eleventh to fourteenth MOS transistors (Trn11 to Trn14), where signals CB0 to CB3 of the bits for the second count value are applied to the gate electrodes of these series-connected transistors (with CB0 on the LSB side), and fifteenth to eighteenth n-type MOS transistors (Trn15 to Trn18), where the source and drain terminals thereof are connected to the corresponding terminals of the Trn11 to Trn14 transistors and the signals PD2 to PD5 of the bits of the high-order four bits of the grayscale data are applied to the gate electrodes thereof. The signals CB0 to CB3 of the bits for the second count value thus correspond to the signals PD2 to PD5 of the high-order four bits of the grayscale data. In addition, the source terminals of Trn14 and Trn18 are connected to the drain terminal of a nineteenth n-type MOS transistor (Trn19). The selection signal ISEL is applied to the gate electrode of Trn19. In addition, the drain terminal of a twentieth n-type MOS transistor (Trn20) is connected to the source terminal of. Trn19. The inverted reset signal XRES is applied to the gate electrode of Trn20 and the power source VSS on the low-potential side is connected to the source terminal thereof.

The pre-charge circuit 310 comprises a p-type MOS transistor (Trp1), where a power source VDD on the high-potential side is connected to the source terminal thereof and the inverted reset signal XRES is applied as a pre-charge signal to the gate electrode thereof.

The drain terminal of Trp1 is connected to the drain terminals of Trn1 and Trn5, the drain terminals of Trn11 and Trn15, and the latch circuit 320.

Note that the substrate potential of the n-type MOS transistors of FIG. 8 is connected to the power source VSS on the low-potential side and the substrate potential of the p-type transistor of FIG. 8 is connected to the power source VDD on the high-potential side.

The thus-configured match detection circuit 202 causes the operation of the first match detection circuit 300 to halt when the logic level of the selection signal ISEL is high, to latch the match detection result of the second match detection circuit 302 in the latch circuit 320. Similarly, it causes the operation of the second match detection circuit 302 to halt when the logic level of the selection signal ISEL is low, to latch the match detection result of the first match detection circuit 300 in the latch circuit 320.

The description below concerns the operation of the first match detection circuit 300 when the logic level of the selection signal ISEL is low, but it should be obvious that the operation of the second match detection circuit 302 is similar.

First of all, if the logic level of the inverted reset signal XRES that acts as a pre-charge signal goes low, the operation of the first and second match detection circuits 300 and 302 is halted and the potential of the drain terminal of Trp1 is pre-charged to the power source VDD on the high-potential side. The logic level corresponding to the drain terminal of Trp1 during this time is inverted and held in the latch circuit 320, so the logic level of the pulse width modulation signal PWMS is low. Note that the various pulse width modulation signals shown in FIG. 4 have logic levels that are opposite to those of the pulse width modulation signal PWMS.

When the logic level of the inverted reset signal XRES subsequently goes high, the path between the nodes ND1 and ND2 becomes conductive when any one of the signal CA0 of a bit for the first count value and the corresponding signal PD2 of the grayscale data bits, the signal CA1 of a bit for the first count value and the corresponding signal PD3 of the grayscale data bits, the signal CA2 of a bit for the first count value and the corresponding signal PD4 of the grayscale data bits, the signal CA3 of a bit for the first count value and the corresponding signal PD5 of the grayscale data bits goes high. If the first count value and the grayscale data have a mutually complementary relationship, the nodes ND1 and ND2 will be at the same potential.

Note that if a negation of the first count value or the grayscale data is supplied to that circuit, the nodes ND1 and ND2 will be at the same potential when the first count value and the grayscale data are mutually equal at the bit level.

If there is conduction between the nodes ND1 and ND2, the logic level of the node ND1 goes low and the pulse width modulation signal PWMS at a high logic level is output by the latch circuit 320.

The thus configured first match detection circuit 300 can switch the pulse width modulation signal PWMS by a match detection result that detects whether or not the signals CA3 to CA0 of the bits for the incremented first count value and the signals PD5 to PD2 of the bits of the 4-bit grayscale data are in a complementary relationship, or whether or not they are equal in bit units. The second match detection circuit 302 can switch the pulse width modulation signal PWMS in a similar manner with respect to the signals CB3 to CB0 of the bits for the incremented second count value.

The decoder circuit selects the pulse width modulation signal PWMS generates by one of the first and second match detection circuits 300 and 302, and outputs it. The decoder circuit is capable of generating the selection signal for selection and output in accordance with the truth table described below.

An example of a truth table used when the decoder circuit of FIG. 7 is implemented in ROM is shown in FIG. 9.

In this case, if the low-order 2-bit signals PD1 and PD0 of the grayscale data are "11" (both at logic level high), for example, this means that the decoding is such that a first count value (CA) for the first frame (frame 1=high). Similarly, the decoding is such that the first count value (CA) is selected for the second frame (frame 2=high), the first count value (CA) is selected for the third frame (frame 3=high), and the first count value (CA) is selected for the fourth frame (frame 4=high), and this decoding result is supplied as the selection signal ISEL to the match detection circuit.

If the low-order 2-bit signals PD1 and PD0 of the grayscale data are "01" (logic levels low-high), for example, a second count value (CB) is selected for the first frame (frame 1=high), the second count value (CB) is selected for the second frame (frame 2=high), the first count value (CA) is selected for the third frame (frame 3=high), and the first count value (CA) is selected for the fourth frame (frame 4=high), and this decoding result is supplied as the selection signal ISEL to the match detection circuit.

It is possible to combine PWM and FRM to implement grayscale display in a simple manner, by the output of the pulse width modulation signal in accordance with the thus supplied selection signal ISEL. In particular, it is also possible to provide a similar grayscale display by providing a circuit that decrements the 4-bit grayscale data by 1 without providing the above described first and second count values, but this would increase the circuit scale and layout area, making it difficult to apply to the X driver which imposes limitations on the width of the SEG output cell. In that case, the first and second match detection circuits that configure the pulse width modulation signal generation circuit 200 of this embodiment make it possible to have a configuration in which n-type transistors are connected in series, as shown in FIG. 8, thus making the layout area extremely small. It is therefore possible to prioritize a simpler configuration and layout area, thus contributing to the implementation of an X driver that enables larger numbers of grayscales with a lower power consumption, without increasing the area of the SEG output cells significantly.

Figure 10:
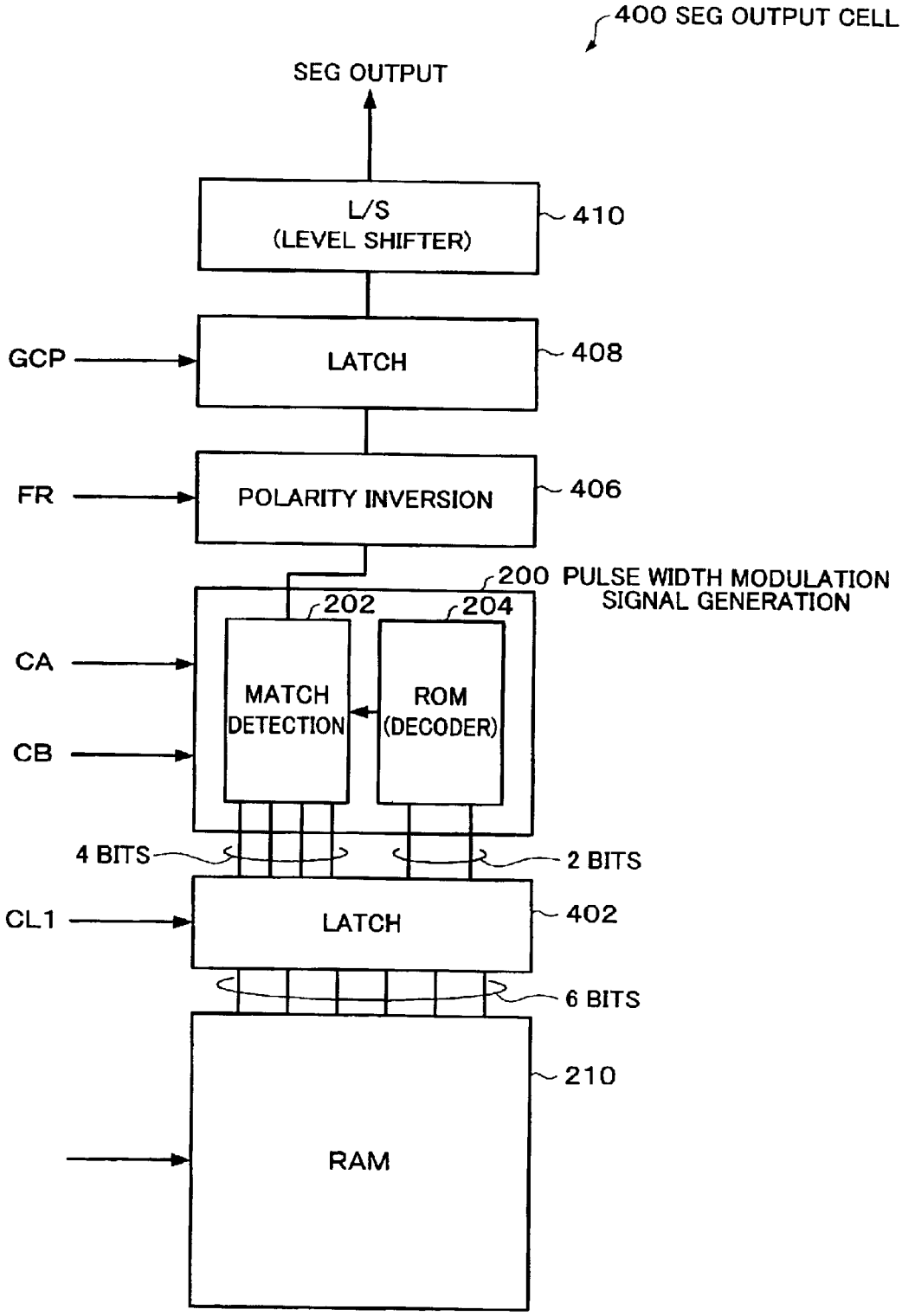
FIG. 10 is illustrative of an example of the configuration of the SEG output cell of the X driver used in the pulse width modulation signal generation circuit of this embodiment.

An example of the configuration of the SEG output cell of the X driver used in the pulse width modulation signal generation circuit of this embodiment is shown in FIG. 10.

In this case, components that are the same as those of the pulse width modulation signal generation circuit of FIG. 7 are given the same reference numbers and further description thereof is omitted.

A SEG output cell 400 is disposed in correspondence to the SEG output electrode of the X driver shown in FIG. 5. The SEG output cell 400 comprises the RAM 210, a latch 402, a pulse width modulation signal generation circuit 200, a polarity inversion circuit 406, a latch 408, and a level shifter (L/S) 410.

The RAM 210, in which the reading and writing are controlled by the G/A, stores 6-bit grayscale data.

The latch 402 latches the grayscale data that has been read from the RAM 210, by a latch signal CL1. The high-order four bits of the latched grayscale data are supplied to the match detection circuit 202 of the pulse width modulation signal generation circuit 200, and the low-order two bits are supplied to the decoder circuit (ROM) 204.

The pulse width modulation signal generation circuit 200 generates the pulse width modulation signal in accordance with the decoding result from the decoder circuit 204, based on the detection of a match between either of the first and second count values CA and CB counted by the first and second counters in the above described G/A and the grayscale-data.

The polarity of the pulse width modulation signal is inverted by a polarity inversion signal FR in the polarity inversion circuit 406. The polarity inversion signal FR regulates the timing at which the SEG output is inverted, every frame or every line, by way of example.

The polarity-inverted signal is latched in the latch 408 by the clock pulse signal GCP, and then level-shifted to a given potential by the level shifter 410. The level-shifted signal is output to the corresponding data line, as the SEG output.

Figure 11:
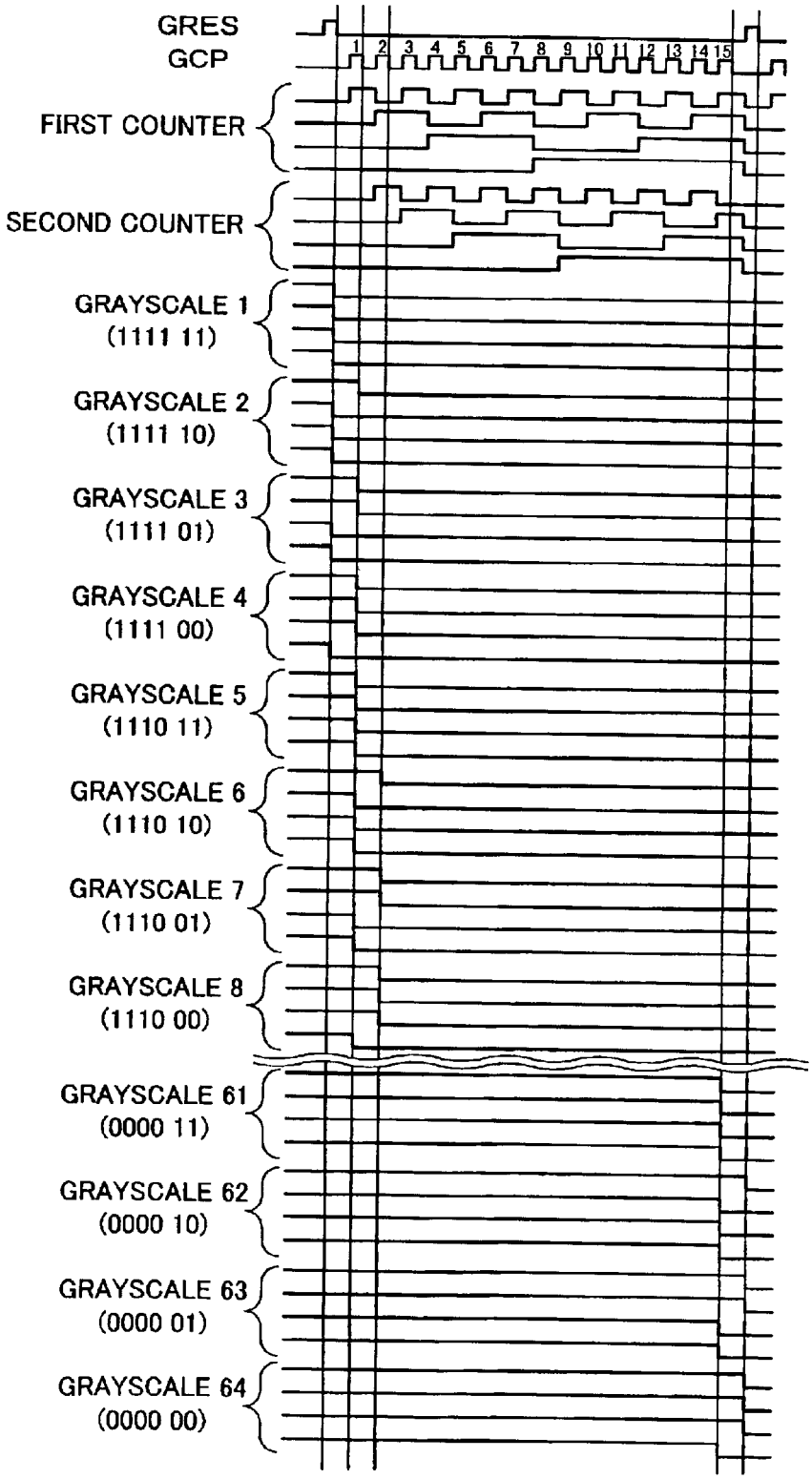
FIG. 11 is a timing chart illustrative of grayscale display by a combination of the 4-bit PWM and the 2-bit FRM of the X driver of this embodiment.

A timing chart used to illustrate the grayscale display obtained by a combination of 4-bit PWM and 2-bit FRM in the X driver of this embodiment is shown in FIG. 11.

A match detection with the grayscale data is obtained by using this first count value and a second count value of a value obtained by delaying the corresponding clock pulse signal GCP by one cycle to subtract 1 therefrom. A transition point in the pulse width modulation signal that is defined by a match detection result between the first count value and the grayscale data therefore occurs one cycle of the clock pulse signal GCP earlier than the transition point in the pulse width modulation signal that is defined by a match detection result between the second count value and the grayscale data.

In that case, it is possible to switch to either of the count values for comparison with the high-order four bits of the grayscale data, by FRM implemented by the low-order two bits of the grayscale data in accordance with the truth table of FIG. 9, making it possible to obtain patterns corresponding to the grayscale data shown in FIG. 4 (or FIG. 11).

3. Electronic Instrument

The description now turns to an application of the electro-optical device comprising the above described X driver 30 to an electronic instrument.

Figure 12:
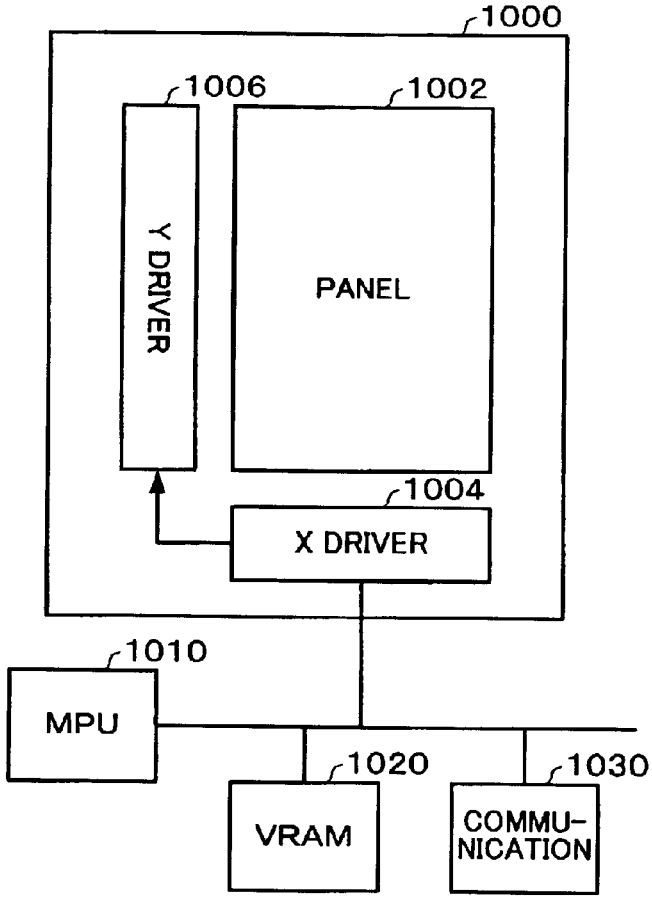
FIG. 12 is a block diagram of an example of the configuration of an electronic instrument to which the electro-optical device of this embodiment is applied.

A typical block diagram of an electronic instrument employing the electro-optical device of this embodiment is shown in FIG. 12.

An electro-optical device 1000 of this embodiment is connected to an MPU 1010 by a bus. This bus is also connected to a VRAM 1020 and a communication section 1030.

The MPU 1010 controls the various components through the bus.

The VRAM 1020 has storage areas corresponding in a one-to-one manner with the pixels of a panel 1002 of the electro-optical device 1000, with the configuration being such that image data written at random by the MPU 1010 can be read out sequentially therefrom in the scan direction.

The communication section 1030 provides the various types of control for communications with the exterior (such as a host device or another electronic instrument), and the functions thereof could be provided by various processors or by hardware such as a communication ASIC and a program or the like.

In this electronic instrument, the MPU 1010 generates the various timing signals that are necessary for driving the panel 1002 of the electro-optical device 1000, and supplies them to an X driver 1004 of the electro-optical device 1000. The X driver 1004 has a configuration similar to that of the X driver 30 of this embodiment. This X driver 1004 outputs a display control signal to a Y driver 1006. The Y driver 1006 drives the scan lines in accordance with this display control signal.

This makes it possible to provide an electronic instrument that enables a reduction in the power consumption and an increase in grayscale.

Figure 13:
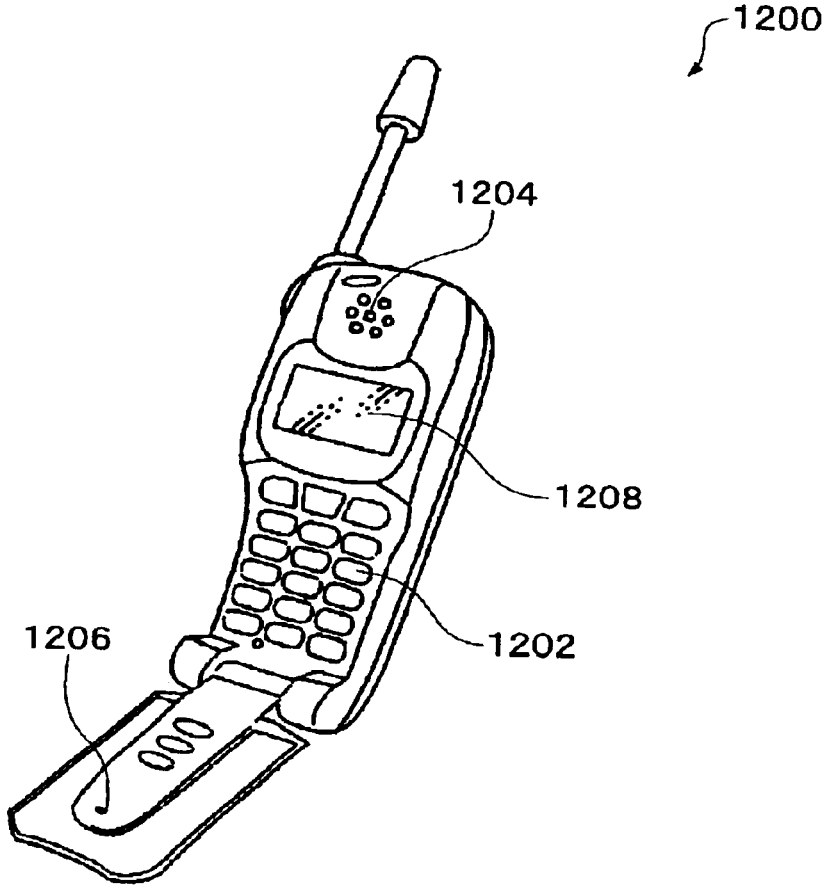
FIG. 13 is a perspective view of a mobile phone to which the electro-optical device of this embodiment is applied.

A perspective view of a mobile phone that utilizes the electro-optical device of this embodiment is shown in FIG. 13.

A mobile phone 1200 is provided with a plurality of operating buttons 1202, a receiver aperture 1204, a transmitter aperture 1206, and a panel 1208. The panel 1208 is a panel that configures the electro-optical device of this embodiment. During standby, this panel 1208 displays details such as signal strength and alphanumerics; during transmission or reception, the entire region becomes a display region. In this case, the power consumption can be reduced by controlling the display region.

Note that the present invention is not limited to the embodiments described above, and thus various modifications thereto are possible.

Note also that the electronic instrument to which the electro-optical device using the X driver of this embodiment is applied is preferably an appliance in which a low power consumption is a particularly strong requirement, such as a pager, timepiece (watch), or PDA, in addition to the above described mobile phone. It is also possible to apply the present invention to liquid-crystal televisions, viewfinder-type or direct-monitor-types of video recorders, car-navigation devices, calculators, dedicated wordprocessors, workstations, TV phones, POS terminals, and appliances provided with touch panels.

This embodiment was described with respect to the use of a TFD as the switching element for each pixel of the liquid-crystal panel, but the present invention is not limited thereto. For example, it is also possible to use a thin-film transistor (TFT) as the switching element.

In addition, this embodiment can not only be applied to an active-matrix type of liquid-crystal panel; it can also be applied to a passive-matrix type of liquid-crystal panel.

Furthermore, the present invention is not limited to the 4-bit PWM and 2-bit FRM signal waveforms describe with reference to this embodiment; it can also be applied in a similar manner to various other waveform patterns combining PWM and FRM.

Even further, this embodiment and examples were described with respect to a display device that uses a liquid crystal as an electro-optical material, but the present invention can also be applied to all devices that use electro-optical effect such as electroluminescence, fluorescent display tubes, plasma displays, or organic EL.

This embodiment can also be applied to a configuration in which the pixels of the panel and the drivers are disposed on a glass substrate, or one in which the drivers are incorporated in a semiconductor device and the panel having the pixel areas is disposed on the same substrate.

In the description of this embodiment above, the second count value was described as being a value that is the first count value with one subtracted therefrom, but the present invention is not limited thereto. Similar effects can be obtained with a second count value that is the first count value with one added thereto, with suitable modifications to the truth table of the decoder circuit.

This embodiment was described as relating to the implementation of a grayscale display obtained by a combination of PWM using four bits of grayscale data and FRM using two bits of grayscale data, but the present invention is not limited to those numbers of bits. In addition, the PWM and FRM could use bits at any position in the grayscale data.

What is claimed is:

1. A pulse width modulation signal generation circuit comprising:

a first match detection circuit which detects a match between a-bit grayscale data and a first count value counted within a given scan period;

a second match detection circuit which detects a match between the a-bit grayscale data and a second count value counted by subtracting or adding one with respect to the first count value; and a selection signal generation circuit which generates a selection signal based on a frame number for identifying a frame and b-bit grayscale data, wherein a transition point in a pulse width modulation signal is defined by one of the match detection results of the first and second match detection circuits, selected based on the selection signal (where "a" and "b" are natural numbers).

2. The pulse width modulation signal generation circuit as defined by claim 1, further comprising:

a pre-charge circuit including a p-type transistor having a source terminal connected to a power source on a high-potential side and a gate electrode to which is applied a given pre-charge signal; and a latch circuit connected to a drain terminal of the p-type transistor, for outputting the pulse width modulation signal, wherein the first match detection circuit includes:

first to a-th n-type transistors connected in series, a signal for each bit of the first count value being applied to a gate electrode of each of the first to a-th n-type transistors;

(a+1)th to 2a-th n-type transistors which are connected to source terminals and drain terminals of the first to a-th n-type transistors respectively, a signal for each bit of the a-bit grayscale data corresponding to each bit of the first count value being applied to a gate electrode of each of the (a+1)th to 2a-th n-type transistors;

a (2a+1)th n-type transistor having a drain terminal connected to source terminals of the a-th and 2a-th n-type transistors and a gate electrode to which an inversion signal of the selection signal is applied; and a (2a+2)th n-type transistor having a drain terminal connected to a source terminal of the (2a+1)th n-type transistor, a gate electrode to which the given pre-charge signal is applied, and a source terminal to which a power source on a low-potential side is connected, wherein the drain terminal of the p-type transistor is connected to the drain terminal of the first n-type transistor, wherein the second match detection circuit includes:

(2a+3)th to (3a+2)th n-type transistors connected in series, a signal for each bit of the second count value being applied to a gate electrode of each of the (2a+3)th to (3a+2)th n-type transistors;

(3a+3)th to (4a+2)th n-type transistors, which are connected to source terminals and drain terminals of the (2a+3)th to (3a+2)th n-type transistors respectively, the signal for each bit of the a-bit grayscale data corresponding to each bit of the second count value being applied to a gate electrode of each of the (3a+3)th to (4a+2)th n-type transistors;

a (4a+3)th n-type transistor having a drain terminal connected to the source terminals of the (3a+2th) and (4a+2)th n-type transistors and a gate electrode to which the selection signal is applied; and a (4a+4)th n-type transistor having a drain terminal connected to a source terminal of the (4a+3)th n-type transistor, a gate electrode to which the given pre-charge signal is applied, and a source terminal to which a power source on the low-potential side is connected, and wherein the drain terminal of the p-type transistor is connected to the drain terminal of the (2a+3)th n-type transistor.

3. A data line drive circuit which drives data lines of an electro-optical device including scan lines and the data lines in which a pixel is defined by one of the scan lines and one of the data lines crossing each other, the data line drive circuit comprising an output cell for each of the data lines, wherein the output cell includes:

a RAM which stores (a+b) bits of grayscale data;

the pulse width modulation signal generation circuit as defined by claim 1, which generates a pulse width modulation signal based on the grayscale data; and a level conversion circuit which converts the pulse width modulation signal to a given potential level to output to the corresponding data line.

4. A data line drive circuit which drives data lines of an electro-optical device including scan lines and the data lines in which a pixel is defined by one of the scan lines and one of the data lines crossing each other, the data line drive circuit comprising an output cell for each of the data lines, wherein the output cell includes:

a RAM which stores (a+b) bits of grayscale data;

the pulse width modulation signal generation circuit as defined by claim 2, which generates a pulse width modulation signal based on the grayscale data; and a level conversion circuit which converts the pulse width modulation signal to a given potential level to output to the corresponding data line.

5. An electro-optical device, comprising:

a pixel defined by one of a plurality of scan lines and one of a plurality of data lines crossing each other;

the data line drive circuit as defined by claim 3, which drives the plurality of data lines; and a scan line drive circuit which drives the plurality of scan lines.

6. An electro-optical device, comprising:

a pixel defined by one of a plurality of scan lines and one of a plurality of data lines crossing each other;

the data line drive circuit as defined by claim 4, which drives the plurality of data lines; and a scan line drive circuit which drives the plurality of scan lines.

7. An electro-optical device, comprising:

a panel having a pixel defined by one of a plurality of scan lines and one of a plurality of data lines crossing each other;

the data line drive circuit as defined by claim 3, which drives the plurality of data lines; and a scan line drive circuit which drives the plurality of scan lines.

8. An electro-optical device, comprising:

a panel having a pixel defined by one of a plurality of scan lines and one of a plurality of data lines crossing each other;

the data line drive circuit as defined by claim 4, which drives the plurality of data lines; and a scan line drive circuit which drives the plurality of scan lines.

9. An electronic instrument comprising the electro-optical device as defined by claim 5.

10. An electronic instrument comprising the electro-optical device as defined by claim 6.

11. An electronic instrument comprising the electro-optical device as defined by claim 7.

12. An electronic instrument comprising the electro-optical device as defined by claim 8.

13. A pulse width modulation signal generation method for generating a pulse width modulation signal comprising:

performing match detection between a-bit grayscale data and a first count value counted within a given scan period, and match detection between the a-bit grayscale data and a second count value counted by subtracting or adding one with respect to the first count value; and generating a pulse width modulation signal in which a transition point is defined by the match detection result of one of the first and second count values, selected by a selection signal generated based on a frame number for identifying a frame and b-bit grayscale data.

14. The method according to claim 13 further comprising converting the pulse width modulation signal to a given potential level to output to a corresponding data line.

15. The method according to claim 13 further comprising independently vertically transferring information charges from the light receiving pixels in the odd line and from the light receiving pixels in the even line.

16. A pulse width modulation signal generation circuit comprising:

means for detecting a match between a-bit grayscale data and a first count value counted within a given scan period;

means for detecting a match between the a-bit grayscale data and a second count value counted by subtracting or adding one with respect to the first count value; and means for generating a selection signal based on a frame number for identifying a frame and b-bit grayscale data, wherein a transition point in a pulse width modulation signal is defined by one of the match detection results from either of the means for detecting, selected based on the selection signal (where "a" and "b" are natural numbers).

17. The pulse width modulation signal generation circuit as defined by claim 16, further comprising means for supplying a pre-charge signal.

18. The pulse width modulation signal generation circuit as defined by claim 16, further comprising means for outputting the pulse width modulation signal.

19. The pulse width modulation signal generation circuit as defined by claim 17, wherein the means for supplying a pre-charge signal includes a p-type transistor.

20. The pulse width modulation signal generation circuit as defined by claim 18, wherein the means for outputting the pulse width modulation signal includes a latch circuit.

* * * * *